US007820353B2

(12) United States Patent
Eida et al.

(10) Patent No.: US 7,820,353 B2
(45) Date of Patent: Oct. 26, 2010

(54) METHOD FOR PRODUCING TONER

(75) Inventors: Akihiro Eida, Wakayama (JP); Takeshi Ashizawa, Wakayama (JP)

(73) Assignee: Kao Corporation, Tokyo (JP)

( * ) Notice: Subject to any disclaimer, the term of this patent is extended or adjusted under 35 U.S.C. 154(b) by 148 days.

(21) Appl. No.: 12/273,073

(22) Filed: Nov. 18, 2008

(65) Prior Publication Data

US 2009/0136865 A1 May 28, 2009

(30) Foreign Application Priority Data

Nov. 26, 2007 (JP) ..... 2007-303926

(51) Int. Cl.
*G03G 9/087* (2006.01)

(52) U.S. Cl. ..... 430/137.1; 430/137.18; 430/137.19; 430/137.2

(58) Field of Classification Search ..... 430/137.1, 430/137.18, 137.19, 137.2
See application file for complete search history.

(56) References Cited

U.S. PATENT DOCUMENTS

| | | | | |
|---|---|---|---|---|
| 7,348,120 | B2 | 3/2008 | Eida et al. | |
| 7,384,721 | B2 | 6/2008 | Eida et al. | |
| 7,422,833 | B2 * | 9/2008 | Niwa et al. | 430/107.1 |
| 7,442,482 | B2 | 10/2008 | Eida | |
| 7,449,275 | B2 | 11/2008 | Eida | |
| 7,553,600 | B2 * | 6/2009 | Kawamura et al. | 430/137.14 |
| 2005/0233237 | A1 | 10/2005 | Eida et al. | |
| 2006/0093942 | A1 | 5/2006 | Eida | |
| 2007/0003857 | A1 | 1/2007 | Eida et al. | |
| 2007/0287090 | A1 | 12/2007 | Eida et al. | |
| 2008/0247787 | A1 * | 10/2008 | Yoshida et al. | 399/286 |
| 2010/0121023 | A1 * | 5/2010 | Fukui et al. | 528/332 |

FOREIGN PATENT DOCUMENTS

| | | |
|---|---|---|
| JP | 2002-40717 | 2/2002 |
| JP | 2003-280266 | 10/2003 |
| JP | 2006-154026 | 6/2006 |

OTHER PUBLICATIONS

U.S. Appl. No. 11/264,555, filed Nov. 4, 2008, Ashizawa, et al.

* cited by examiner

*Primary Examiner*—Hoa V Le
(74) *Attorney, Agent, or Firm*—Oblon, Spivak, McClelland, Maier & Neustadt, L.L.P.

(57) ABSTRACT

A method for producing a toner, including at least the following steps: step (A): pulverizing a negatively chargeable charge control resin that does not soften at a temperature of 180° C. or lower to an average particle size of from 0.05 to 2 μm; step (B): melt-kneading at least a pulverized product of the negatively chargeable charge control resin obtained in the step (A), a resin binder, and a colorant; and step (C): pulverizing a melt-kneaded product obtained in the step (B) and classifying the pulverized product. The toner obtained according to the present invention is suitably used in, for example, the development of a latent image formed in electrophotography, electrostatic recording method, electrostatic printing method or the like.

17 Claims, No Drawings

METHOD FOR PRODUCING TONER

FIELD OF THE INVENTION

The present invention relates to a method for producing a toner, which is used in, for example, the development of a latent image formed in electrophotography, electrostatic recording method, electrostatic printing method or the like.

BACKGROUND OF THE INVENTION

Charge control resins have been used to give electric charges to toners, among which the negatively chargeable charge control resins which are colorless, white or pale-colored that are applicable for color toners include copolymers of a sulfonate group-containing acrylamide monomer and a vinyl monomer, a polycondensed product obtained by polycondensation reaction of a phenol and an aldehyde, and calixarene compounds, and the like. However, a further improvement in triboelectric chargeability has been desired for the toner in which the above-mentioned polycondensed product is used.

On the other hand, for example, JP-A-2002-40717 discloses a technique in which a charge control resin is present in the form of fine particles having specified length and width, by controlling the state of phase separation of the charge control resin using a resin binder containing a specified amount of a tetrahydrofuran (THF)-insoluble component, for the purposes of being free from background fog in any of low-humidity environment to high-humidity environment, showing excellent developability, and satisfying both the low-temperature fixing ability and the high-temperature offset resistance.

In addition, JP-A-2003-280266 discloses a toner containing at least a colorant and a calixarene compound as a charge control agent, obtained by dissolving a toner composition containing a modified polyester resin capable of forming a urea bond as a resin binder in an organic solvent, subjecting the solution to a poly-addition reaction in an aqueous medium to give a dispersion, removing the solvent of this dispersion, and washing the residue, for the purpose of obtaining a toner in which a charge control agent is homogeneously dispersed in the toner particles, thereby giving a stable triboelectric chargeability over a long period of time. Further, JP-A-2003-280266 discloses that a resin binder and a charge control agent are previously kneaded, whereby giving a state in which the resin binder and the charge control agent are initially sufficiently adhered to each other, thereby providing a state in which the dispersion is effectively carried out; consequently, the charge control agent is excellently dispersed in the resin binder, so that the dispersion diameter of the charge control agent becomes small, thereby giving excellent triboelectric properties, and that a resin binder, a charge control agent, and a solvent are mixed with a blender such as a Henschel mixer, upon previously kneading the resin binder and the charge control agent, and the resulting mixture is kneaded at a temperature lower than a melting temperature of the resin binder, with a kneader such as a twin roller or triple roller kneader to give a sample.

On the other hand, as a technique of pulverizing a charge control agent, JP-A-2006-154026 discloses a toner for electrostatic development containing a fine quaternary ammonium salt compound adjusted to a specified BET specific surface area by wet pulverization, for the purpose of sufficiently having charge control effects such as excellent triboelectric stability and triboelectric retainability even with a small amount of use.

SUMMARY OF THE INVENTION

The present invention relates to:

[1] a method for producing a toner, including at least the following steps (A) to (C):

step (A): pulverizing a negatively chargeable charge control resin that does not soften at a temperature of 180° C. or lower to an average particle size of from 0.05 to 2 μm;

step (B): melt-kneading at least a pulverized product of the negatively chargeable charge control resin obtained in the step (A), a resin binder, and a colorant; and step (C): pulverizing a melt-kneaded product obtained in the step (B) and classifying the pulverized product; and

[2] a method for producing a toner, including at least the following steps (B') and (C'):

step (B'): melt-kneading a negatively chargeable charge control resin that does not soften at a temperature of 180° C. or lower and has an average particle size of from 0.05 to 2 μm, a resin binder, and a colorant; and step (C'): pulverizing a melt-kneaded product obtained in the step (B') and classifying the pulverized product.

DETAILED DESCRIPTION OF THE INVENTION

The present invention relates to a method for producing a toner having excellent triboelectric chargeability and high-temperature offset resistance in a pulverized toner containing a negatively chargeable charge control resin.

According to the method for producing a toner of the present invention, a toner having excellent triboelectric chargeability and high-temperature offset resistance in a pulverized toner containing a negatively chargeable charge control resin can be obtained.

These and other advantages of the present invention will be apparent from the following description.

In JP-A-2002-40717, a vinyl-based polymer has been used as a charge control resin. This charge control resin, in general, has a softening temperature of 180° C. or lower, and the charge control resin can be dispersed in the resin binder by kneading. However, it would be difficult to disperse a charge control resin that does not soften at 180° C. by kneading with the resin. JP-A-2003-280266 describes that the dispersion diameter can be made smaller by kneading a calixarene compound together with a resin binder; however, the publication does not disclose that the calixarene compound itself is pulverized to a smaller particle size. In addition, a toner disclosed in JP-A-2003-280266 is produced by kneading a solution of the resin binder and a calixarene compound together with a solvent, dissolving the components in the solvent, subjecting the solution to a poly-addition reaction in an aqueous solvent, and removing the solvent, and this toner is not a toner obtained by pulverization method. In order to make the dispersion diameter smaller according to the pulverization method, a method of strongly kneading a negatively chargeable charge control resin and a resin binder in the melt-kneading with the resin binder is employed; however, according to this method, it has been found that there arises some disadvantages in the high-temperature offset resistance. In the kneading of the resin binder and the calixarene compound of JP-A-2003-280266, a solvent is used together, and a resin before the poly-addition reaction is used, so that the kneading is not strongly applied as in the pulverization method.

As a result of intensive studies for obtaining a toner having excellent triboelectric chargeability and high-temperature offset resistance in the pulverized toner containing a negatively chargeable charge control resin, the present inventors have found that in a method for producing a pulverized toner containing a negatively chargeable charge control resin, as a means of homogeneously dispersing the negatively chargeable charge control resin in the resin binder, a toner having excellent triboelectric chargeability and high-temperature offset resistance is obtained by kneading a resin binder and a negatively chargeable charge controlling resin of which particle size is made smaller by previously pulverizing the resin, rather than strongly kneading the negatively chargeable charge control resin and the resin binder to improve dispersibility, and the present invention has been perfected thereby.

The method for producing a toner of the present invention includes the following steps:

step (A): pulverizing a negatively chargeable charge control resin that does not soften at a temperature of 180° C. or lower to an average particle size of from 0.05 to 2 μm;

step (B): melt-kneading at least a pulverized product of the negatively chargeable charge control resin obtained in the step (A), a resin binder, and a colorant; and step (C): pulverizing a melt-kneaded product obtained in the step (B) and classifying the pulverized product, and one of the features of the present invention resides in that the negatively chargeable charge control resin pulverized in the step (A) is melt-kneaded with the raw materials for the toner containing a resin binder in the step (B). In the method for producing a toner of the present invention, the dispersion of the negatively chargeable charge control resin in the resin binder is improved, so long as the negatively chargeable charge control resin to be used in melt-kneading has an average particle size of from 0.05 to 2 μm; therefore, in a case where a negatively chargeable charge control resin that is unpulverized has an average particle size within the above range, a pulverizing step of the negatively chargeable charge control resin is not necessitated. Therefore, the present invention also encompasses an embodiment that does not include the step (A) in the above method, specifically, an embodiment including the following steps:

step (B'): melt-kneading a negatively chargeable charge control resin that does not soften at a temperature of 180° C. or lower and has an average particle size of from 0.05 to 2 μm, a resin binder, and a colorant; and step (C'): pulverizing a melt-kneaded product obtained in the step (B') and classifying the pulverized product.

As the negatively chargeable charge control resin, a polyester resin, a phenolic resin or the like is used, among which those that have excellent triboelectric chargeability do not in many cases soften at 180° C., which is a temperature higher than the kneading temperature of the resin binder (usually at most 150° C. or so). The negatively chargeable charge control resin that does not soften at 180° C. does not soften during the melt-kneading with the resin binder, thereby giving poor dispersibility in the resulting toner; therefore, the viscoelastic properties of the resin binder during fixing of the toner are inhibited, thereby making it likely to worsen the offset, and an effect of improving triboelectric charges is likely to be smaller. In view of the above, the dispersibility of the negatively chargeable charge control resin has been tried to be improved by adjusting the conditions for melt-kneading; however, simply adjusting the conditions for melt-kneading not only does not give sufficient dispersibility, but also leads to the deterioration of the resin binder, thereby making likely to lower the high-temperature offset. In the present invention, it is deduced that the negatively chargeable charge control resin is previously pulverized to a smaller particle size, or a negatively chargeable charge control resin having a small particle size is used, thereby providing an excellent dispersibility of the negatively chargeable charge control resin, to give a toner capable of satisfying both the triboelectric chargeability and the high-temperature offset resistance without inhibiting the viscoelastic properties inherently owned by the resin binder.

In the step(A), a negatively chargeable charge control resin that does not soften to 180° C. or lower is pulverized to an average particle size of from 0.05 to 2 μm, and in the step (B'), a negatively chargeable charge control resin that does not soften to 180° C. or lower and has an average particle size of from 0.05 to 2 μm is used.

The negatively chargeable charge control resin that does not soften to 180° C. or lower in the present invention is not limited in its softening point so long as the resin does not soften at 180° C. or lower, and a known one can be used. The resin includes, for example, a polycondensed product (a phenolic resin) obtained by polycondensation reaction of a phenol and an aldehyde, a calixarene compound, and the like. Among them, the polycondensed product obtained by polycondensation of a phenol and an aldehyde and the calixarene compound are preferred, from the viewpoint of triboelectric chargeability of the toner, and the polycondensed product obtained by polycondensation of a phenol and an aldehyde is more preferred, from the viewpoint of the temperature of high-temperature offset generation of the toner. Here, the judgment that the resin does not soften at 180° C. or lower is carried out according to the method described in Examples set forth below.

The polycondensed product obtained by a polycondensation reaction of a phenol and an aldehyde in the present invention is not particularly limited, so long as the polycondensed product is obtained by polycondensing the phenols and the aldehydes given below.

As the phenol, a raw material containing a p-alkylphenol (a) having one phenolic hydroxyl group and having no substituents at the ortho-position, and a bisphenol compound (b) having two phenolic hydroxyl groups and having no substituents at the ortho-position of each hydroxyl group is used. Here, the phrase "having no substituents" means that both of the carbon atoms adjoining the carbon atom bound to a hydroxyl group is only bound to a hydrogen atom except for being bound to other carbon atoms forming an aromatic ring together with the carbon bound to a hydroxyl group. By the polycondensation reaction of a phenol and an aldehyde, the aldehyde is added to the carbon adjoining the phenolic hydroxyl group of the phenol, whereby presumably forming a polycondensed product in which the phenol and the aldehyde are alternately connected to each other. This polycondensed product has a structure in which a phenol having excellent charge retention is connected, so that it is deduced that excellent triboelectric chargeability is obtained.

It is preferable that the p-alkylphenol (a) includes a p-alkylphenol represented by the formula (i):

(i)

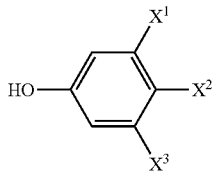

wherein each of $X^1$ and $X^3$ is independently a hydrogen atom, a halogen, or an alkyl group having 1 to 3 carbon atoms; and $X^2$ is an alkyl group having 1 to 12 carbon atoms, and preferably from 4 to 8 carbon atoms.

The p-alkylphenol represented by the formula (i) includes p-t-butylphenol, p-t-octylphenol, p-t-dodecylphenol, and the like.

It is preferable that the bisphenol compound (b) includes a bisphenol compound represented by the formula (ii):

(ii)

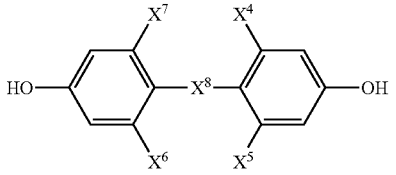

wherein each of $X^4$, $X^5$, $X^6$ and $X^7$ is independently a hydrogen atom, a halogen, or an alkyl group having 1 to 3 carbon atoms; and $X^8$ is an alkylene group having 1 to 5 carbon atoms, and preferably 3 carbon atoms.

The bisphenol compound represented by the formula (ii) includes a bisphenol A such as 2,2-bis(4-hydroxyphenyl)propane.

It is preferable that as the aldehyde, at least one member selected from the group consisting of paraformaldehyde and formaldehyde is used.

The p-alkylphenol (a) is contained in an amount of preferably from 70 to 99% by mol, and more preferably from 80 to 98% by mol, of the phenol moiety as a constituting unit of the above-mentioned polycondensed product, from the viewpoint of triboelectric chargeability of the toner.

The bisphenol compound (b) is contained in an amount of preferably from 1 to 30% by mol, and more preferably from 2 to 20% by mol, of the phenol moiety as a constituting unit of the above-mentioned polycondensed product, from the viewpoint of dispersibility of the resin binder.

The molar ratio of the p-alkylphenol (a) to the bisphenol compound (b), i.e. a/b, in the phenol moiety as a constituting unit of the above-mentioned polycondensed product, is preferably from 99/1 to 70/30, and more preferably from 98/2 to 80/20.

The molar ratio for the raw materials for the polycondensation reaction of the phenol to the aldehyde, i.e. the phenol/the aldehyde, is preferably from 1/0.5 to 1/5, and more preferably from 1/1.0 to 1/2.

The polycondensation reaction method of a phenol and an aldehyde includes, for example, a method including the steps of adding a phenol and an aldehyde in an organic solvent such as xylene, reacting the components at a temperature from 80° C. to a boiling point of the solvent for 3 to 20 hours in the presence of a strongly basic compound such as a hydroxide of an alkali metal or an alkaline earth metal, while distilling off water, and recrystallizing from a poor solvent such as an alcohol; and a method including the steps of vacuum-drying an organic solvent, and thereafter washing the residue with an alcohol such as methanol, ethanol, or isopropanol. As the strongly basic compound, sodium hydroxide, rubidium hydroxide, potassium hydroxide or the like can be preferably used.

The polycondensed product obtained by polycondensation reaction of a phenol and an aldehyde is contained in an amount of preferably from 0.1 to 5 parts by weight, and more preferably from 0.2 to 4 parts by weight, based on 100 parts by weight of the resin binder.

The calixarene compound is preferably a compound represented by the formula (I):

(I)

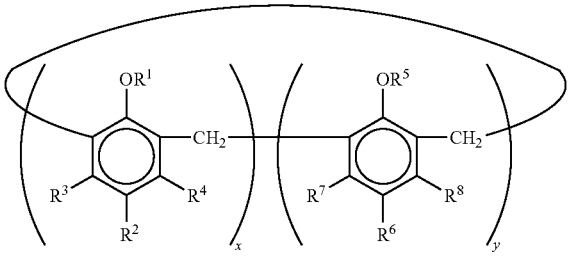

wherein each of $R^1$ and $R^5$ is independently a hydrogen atom, an alkyl group having 1 to 5 carbon atoms, or $—(CH_2)_m COOR^9$, wherein $R^9$ is a hydrogen atom or an alkyl group having 1 to 3 carbon atoms, and m is an integer of from 1 to 3, each of $R^2$, $R^3$, $R^4$, $R^6$, $R^7$, and $R^8$ is independently a hydrogen atom, a halogen atom, an alkyl group, an alkoxy group, an acyl group, or a cycloalkyl group each having 1 to 12 carbon atoms, an aryl group having 6 to 12 carbon atoms, a hydroxyl group, a carboxyl group, an amino group which may be substituted with an alkyl group and/or an acyl group, each having 1 to 12 carbon atoms, a nitro group, a sulfonate group, a sulfonamide, a carbamoyl group, or a cyano group, x is an integer of from 4 to 8, and y is an integer of from 0 to 4, wherein the sum of x and y is from 4 to 8, and more preferably a compound represented by the formula (Ia):

(Ia)

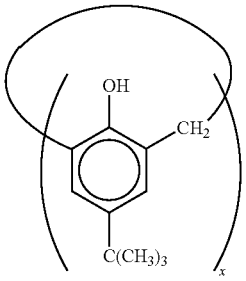

wherein x is as defined above. As the compound represented by the formula (Ia), it is preferable that the compound contains a compound in which x is 8, and more preferably contains a mixture of compounds in which x is from 6 to 8.

The amount of the calixarene compound formulated is preferably from 0.1 to 3 parts by weight, and more preferably from 0.5 to 3 parts by weight, based on 100 parts by weight of the resin binder.

The toner in the present invention may properly contain other negatively chargeable charge control agent besides the polycondensed product obtained by polycondensation reaction of a phenol and an aldehyde and the calixarene compound, within the range so as not to impair the effects of the present invention. Other negatively chargeable charge control agents are not particularly limited, so long as the agent does not soften at a temperature of 180° C. or lower. The polycondensed product obtained by polycondensation reaction of a phenol and an aldehyde and the calixarene compound are contained in a total amount of preferably 50% by weight or more, and more preferably 80% by weight or more, of the negatively chargeable charge control agent.

A method of pulverizing the negatively chargeable charge control resin is not particularly limited, and wet pulverization with a ball-mill, including the step of mixing a pulverizing means such as balls and a product to be pulverized in a dispersion medium by driving a vessel, medium agitation, or the like; or dry pulverization using a jet mill in which a product to be pulverized is bombarded with a jet stream by means of a fluidized bed jet mill, a gas stream jet mill, or the like may be employed. The wet pulverization is preferred from the viewpoint of making it less likely to cause fusion of the negatively chargeable charge control resin during the pulverization, and being more easily likely to obtain particles having smaller particle sizes.

As the dispersion medium used in wet pulverization, besides water, an alcohol solvent such as methanol, ethanol, or isopropanol can be used alone or in a mixture of two or more kinds. The alcohol solvent such as methanol, ethanol, or isopropanol is preferred, and ethanol is more preferred, from the viewpoint of improving the dispersibility of the negatively chargeable charge control resin.

The concentration of the negatively chargeable charge control resin in the slurry prepared using the above-mentioned dispersion medium is preferably from 5 to 30% by weight, and more preferably from 10 to 20% by weight.

The mixing temperature is not particularly limited. The mixing temperature is preferably 5° C. or higher, and more preferably 10° C. or higher, from the viewpoint of stability of the slurry concentration. In addition, the mixing temperature is preferably 40° C. or lower, and more preferably 30° C. or lower, from the viewpoint of stability of the slurry concentration. From these viewpoints, the mixing temperature is preferably from 5° to 40° C., and more preferably from 10° to 30° C. The mixing time is not particularly limited. The mixing time is preferably 10 minutes or longer, and more preferably 30 minutes or longer, from the viewpoint of pulverizability of the negatively chargeable charge control resin. In addition, the mixing time is preferably 180 minutes or shorter, and more preferably 120 minutes or shorter, from the viewpoint of the productivity of the pulverized product of the negatively chargeable charge control resin. Therefore, the mixing time is preferably from 10 to 180 minutes, and more preferably from 30 to 120 minutes, from the viewpoint of pulverizability and productivity.

Here, in a case where the negatively chargeable charge control resin is pulverized by wet pulverization, according to a known method, a dispersion medium may be removed, or an aggregate of the negatively chargeable charge control resin obtained by removing the dispersion medium may be disintegrated with a mixer, and removed by a classifier or the like.

The pulverized product of the negatively chargeable charge control resin obtained in the step (A) has an average particle size of 0.05 to 2 μm, preferably from 0.05 to 1 μm, and more preferably from 0.1 to 0.5 μm. In addition, the negatively chargeable charge control resin used in the step (B') has an average particle size of from 0.05 to 2 μm, preferably from 0.05 to 1 μm, and more preferably from 0.1 to 0.5 μm. The average particle size of the negatively chargeable charge control resin in the present specification is measured according to the method described in Examples set forth below.

Thus, the pulverized product of the negatively chargeable charge control resin that does not soften at a temperature of 180° C. or lower obtained in the step (A) is used in the step (B), and the negatively chargeable charge control resin that does not soften at a temperature of 180° C. or lower and has an average particle size of from 0.05 to 2 μm is used in the step (B').

In the step (B), at least the pulverized product of the negatively chargeable charge control resin obtained in the step (A), a resin binder, and a colorant are melt-kneaded, and in the step (B'), at least the negatively chargeable charge control resin that does not soften at a temperature of 180° C. or lower and has an average particle size of from 0.05 to 2 μm, a resin binder, and a colorant are melt-kneaded.

As the resin binder in the present invention, those resin binders having a softening point lower than a softening point of the negatively chargeable charge control resin are preferred, from the viewpoint of exhibiting an effect in pulverization of the negatively chargeable charge control resin.

The resin binder has a softening point of preferably from 110° to 150° C., and more preferably from 115° to 140° C. In a case where two or more resins are used as a resin binder, an average softening point obtained by taking a weighed average is defined as a softening point of the resin binder, and it is desired that the average softening point is within the above-mentioned range. In addition, the resin binder has a glass transition temperature of preferably from 50° to 85° C., and more preferably from 55° to 80° C. The softening point and the glass transition temperature of the resin binder are measured according to the methods described in Examples set forth below.

The resin binder includes polyesters, vinyl resins, epoxy resins, polycarbonates, polyurethanes, and the like. Among them, the polyesters are preferred, from the viewpoint of offset properties of the toner. The polyester is contained in an amount of preferably 95% by weigh or more, more preferably 99% by weight or more, and even more preferably substantially 100% by weight, of the resin binder.

The polyester is obtained by polycondensing a known alcohol component and a known carboxylic acid component, such as a carboxylic acid, a carboxylic acid anhydride, or a carboxylic acid ester.

It is preferable that the alcohol component contains an alkylene oxide adduct of bisphenol A represented by the formula (II):

(II)

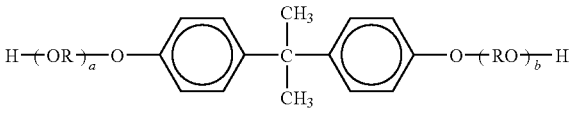

wherein RO is an oxyalkylene group, wherein R is an ethylene and/or propylene group, a and b each shows the number of moles of the alkylene oxide added, each being a positive number, and the sum of a and b on average is preferably from 1 to 16, more preferably from 1 to 8, and even more preferably from 1.5 to 4, from the viewpoint of triboelectric chargeability and high-temperature offset resistance of the toner.

The alkylene oxide adduct of bisphenol A represented by the formula (II) includes alkylene (2 or 3 carbon atoms) oxide (average number of moles: 1 to 16) adducts of bisphenol A such as polyoxypropylene-2,2-bis(4-hydroxyphenyl)propane and polyoxyethylene-2,2-bis(4-hydroxyphenyl)propane, and the like.

The alcohol component other than the alkylene oxide adduct of bisphenol A represented by the formula (II) includes ethylene glycol, 1,2-propylene glycol, 1,4-butanediol, neopentyl glycol, polyethylene glycol, polypropylene glycol, hydrogenated bisphenol A, and the like.

The compound represented by the formula (II) is contained in an amount of preferably 30% by mol or more, more preferably 50% by mol or more, even more preferably 80% by mol or more, and even more preferably substantially 100% by mol, of the alcohol component.

The carboxylic acid component includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; aromatic dicarboxylic acids such as phthalic acid, isophthalic acid, and terephthalic acid; alicyclic dicarboxylic acids such as cyclohexanedicarboxylic acid; tricarboxylic or higher polycarboxylic acids such as trimellitic acid and pyromellitic acid; acid anhydrides thereof, alkyl(1 to 3 carbon atoms) esters thereof; and the like. The above-mentioned acids, acid anhydrides and alkyl esters of the acids are collectively referred to herein as carboxylic acid compound.

The alcohol component may properly contain a monohydric alcohol, and the carboxylic acid component may properly contain a monocarboxylic acid compound, from the viewpoint of adjusting the molecular weight and improving the offset resistance of the toner.

The polycondensation of the alcohol component and the carboxylic acid component can be carried out, for example, at a temperature of from 180° to 250° C. in an inert gas atmosphere, and it is preferable that the polycondensation reaction is carried out in the presence of an esterification catalyst, for example, dibutyltin oxide, from the viewpoint of more remarkably exhibiting the effects of the present invention.

The amount of the esterification catalyst that is present in the reaction system is preferably from 0.05 to 1 part by weight, and more preferably from 0.1 to 0.8 parts by weight, based on 100 parts by weight of a total amount of the alcohol component and the carboxylic acid component.

Here, in the present invention, the polyester may be a modified polyester to an extent that the properties thereof are not substantially impaired. The modified polyester refers to, for example, a polyester grafted or blocked with a phenol, a urethane, an epoxy or the like according to the method described in JP-A-Hei-11-133668, JP-A-Hei-10-239903, JP-A-Hei-8-20636, or the like.

In the present invention, it is preferable that the polyester contains at least two resins, from the viewpoint of the fixing ability of the toner. Specifically, it is desired that the polyester is a combination of a high-softening point polyester having a softening point of preferably exceeding 140° C. and 170° C. or lower, more preferably from 150° to 170° C., and a low-softening point polyester having a softening point of preferably from 90° to 140° C., and more preferably from 110° to 140° C. In addition, the difference in the softening points between the high-softening point polyester and the low-softening point polyester is preferably from 20° to 60° C., and more preferably from 20° to 40° C., from the viewpoint of fixing ability and storage property of the toner. Here, in a case where the polyester contains three or more resins, it is preferable that two kinds of resins of those contained in larger amounts satisfy the above requirements. For example, in a case where the second and the third largest amounts are of the same level, it is preferable that the one contained in the largest amount and either one of the second largest amounts satisfy the above requirements. In addition, it is preferable that all of the polyesters have softening points lower than that of the negatively chargeable charge control resin, from the viewpoint of exhibiting an effect of the pulverization of the negatively chargeable charge control resin in the present invention.

The high-softening point polyester and the low-softening point polyester has a weight ratio, i.e. high-softening point polyester/low-softening point polyester, of preferably from 1/9 to 9/1, and more preferably from 2/8 to 8/2.

As the polyester in the present invention, those having an average softening point of preferably from 110° to 150° C., and more preferably from 115° to 140° C. The term "average softening point" as use herein refers to a softening point of the polyester itself when one kind of the polyester is used, or a weighed-average softening point when two or more kinds of the polyesters are used, and the softening point of each of the polyesters is measured according to the method described in Examples set forth below. In addition, it is preferable that the average softening point is lower than the softening point of the negatively chargeable charge control resin, from the viewpoint of exhibiting an effect of pulverization of the negatively chargeable charge control resin in the present invention.

The polyester has a glass transition temperature of preferably from 50° to 85° C., and more preferably from 55° to 80° C. The polyester has an acid value of preferably from 0.5 to 40 mg KOH/g, and more preferably from 0.5 to 30 mg KOH/g, from the viewpoint of improving triboelectric chargeability. The glass transition temperature and the acid value of each of the polyesters as used herein are measured according to the method described in Examples set forth below.

In addition, it is preferable that the resin binder in the present invention contains at least a polyester having low crystallinity (hereinafter referred to as "polyester (A)") and a polyester having high crystallinity (hereinafter referred to as "polyester (B)").

The crystallinity of the resin is expressed by a crystallization index defined as a ratio of a softening point to a highest temperature of endothermic peak determined with a differential scanning calorimeter, i.e., softening point/highest temperature of endothermic peak. Generally, when the above-mentioned value exceeds 1.5, the resin is amorphous; and when the value is less than 0.6, the resin is low in crystallinity and mostly amorphous. The crystallinity of the resin can be adjusted by the kinds of the raw material monomers and a ratio thereof, production conditions (for example, reaction temperature, reaction time, and cooling rate), and the like. In the present invention, the term "polyester having high crystallinity" refers to a polyester having a crystallization index of from 0.6 to 1.5, and preferably from 0.8 to 1.2, and the term "polyester having low crystallinity" refers to a resin having a crystallization index of more than 1.5, or less than 0.6, and preferably more than 1.5. Here, the highest temperature of endothermic peak refers to a temperature of the peak on the highest temperature side among endothermic peaks observed. When a difference between the highest temperature of endothermic peak and the softening point is within 20° C., the highest temperature of endothermic peak is defined as a melting point. When the difference between the highest temperature of endothermic peak and the softening point exceeds 20° C., the peak is ascribed to a glass transition.

The polyester (A) having low crystallinity is obtained by polycondensing an alcohol component containing an alkylene oxide adduct of bisphenol A in an amount of 90 to 100% by mol, and preferably from 95 to 100% by mol, and a carboxylic acid component containing an aromatic carboxylic acid compound in an amount of 75 to 100% by mol, preferably from 85 to 100% by mol, and more preferably from 90 to 100% by mol.

It is preferable that the alkylene oxide adduct of bisphenol A contains an alkylene oxide adduct of bisphenol A represented by the above-mentioned formula (II):

(II)

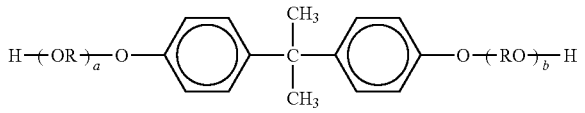

wherein RO is an oxyalkylene group, wherein R is an ethylene and/or propylene group, a and b each shows the number of moles of the alkylene oxide added, each being a positive number, and the sum of a and b on average is preferably from 1 to 16, more preferably from 1 to 8, and even more preferably from 1.5 to 4, from the viewpoint of triboelectric chargeability and durability of the toner.

The alkylene oxide adduct of bisphenol A represented by the formula (II) includes the same adducts as mentioned above, including the alkylene (2 or 3 carbon atoms) oxide (average number of moles: 1 to 16) adduct of bisphenol A such as polyoxypropylene-2,2-bis(4-hydroxyphenyl)propane, polyoxyethylene-2,2-bis(4-hydroxyphenyl)propane, and the like.

The alcohol component other than the alkylene oxide adduct of bisphenol A represented by the formula (II) includes the same components as mentioned above, including ethylene glycol, 1,2-propylene glycol, 1,4-butanediol, neopentyl glycol, polyethylene glycol, polypropylene glycol, hydrogenated bisphenol A, and the like.

The aromatic carboxylic acid compound includes aromatic dicarboxylic acids such as phthalic acid, isophthalic acid, and terephthalic acid; aromatic tricarboxylic or higher carboxylic acid compounds such as 1,2,4-benzenetricarboxylic acid (trimellitic acid), 2,5,7-naphthalenetricarboxylic acid, and pyromellitic acid; carboxylic acid compounds such as acid anhydrides thereof, and alkyl(1 to 3 carbon atoms) esters thereof; and the like. Among them, terephthalic acid and isophthalic acid are preferable, and terephthalic acid is more preferable, from the viewpoint of environmental stability and durability of the toner. The carboxylic acids, acid anhydrides thereof, and alkyl esters thereof are collectively referred to herein as a carboxylic acid compound.

The carboxylic acid component other than the aromatic carboxylic acid compound includes carboxylic acid compounds, such as oxalic acid, malonic acid, maleic acid, fumaric acid, citraconic acid, itaconic acid, glutaconic acid, succinic acid, and adipic acid, acid anhydrides of these acids, and alkyl(1 to 3 carbon atoms) esters of these acids; and the like.

In the polyester (A), the alcohol component may properly contain a monohydric alcohol, and the carboxylic acid component may properly contain a monocarboxylic acid compound, from the viewpoint of adjusting the molecular weight and improving the offset resistance.

The polycondensation of the alcohol component and the carboxylic acid component in the polyester (A) can be carried out, for example, at a temperature of from 180° to 250° C. in an inert gas atmosphere, and it is preferable that the polycondensation reaction is carried out in the presence of an esterification catalyst, for example, tin octylate, from the viewpoint of more remarkably exhibiting the effects of the present invention.

The amount of the esterification catalyst that is present in the reaction system is preferably from 0.05 to 1 part by weight, and more preferably from 0.1 to 0.8 parts by weight, based on 100 parts by weight of a total amount of the alcohol component and the carboxylic acid component.

The polyester (A) has a softening point of preferably from 70° to 140° C., more preferably from 80° to 140° C., and even more preferably from 85° to 135° C., from the viewpoint of fixing ability of the toner. The polyester (A) has a glass transition temperature of preferably from 40° to 70° C., and more preferably from 55° to 70° C., and an acid value of preferably from 5 to 25 mgKOH/g, and more preferably from 5 to 15 mgKOH/g. The softening point, the glass transition temperature, and the acid value as used herein are measured according to the methods described in Examples set forth below.

The polyester (B) having high crystallinity is obtained by polycondensing an alcohol component containing an α,ω-linear alkanediol in an amount of from 90 to 100% by mol, and preferably from 95 to 100% by mol and a carboxylic acid component containing an aliphatic dicarboxylic acid compound in an amount of from 90 to 100% by mol, and preferably from 95 to 100% by mol.

The α,ω-linear alkanediol includes ethylene glycol, 1,3-propylene glycol, 1,4-butanediol, 1,5-pentanediol, 1,6-hexanediol, and the like. Among them, 1,4-butenediol and 1,6-hexanediol are preferable.

The aliphatic dicarboxylic acid compound includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; acid anhydrides thereof, alkyl(1 to 3 carbon atoms) esters thereof; and the like. Among them, fumaric acid is preferable. Here, the aliphatic dicarboxylic acid compound refers to aliphatic dicarboxylic acids, anhydrides thereof, and alkyl(1 to 3 carbon atoms) ester thereof, as mentioned above. Among them, the aliphatic dicarboxylic acids are preferable.

The molar ratio of the aliphatic dicarboxylic acid compound to the α,ω-linear alkanediol in the polyester having high crystallinity in the present invention, i.e., aliphatic dicarboxylic acid compound/α,ω-linear alkanediol, is preferably from 0.9 or more and less than 1.0, and more preferably from 0.95 or more and less than 1.0, from the viewpoint of production stability, and further from the viewpoint of being capable of easily adjusting the molecular weight of the resin by evaporation during a vacuum reaction in a case where the α,ω-linear alkanediol is contained in a large amount.

The polycondensation of the alcohol component and the carboxylic acid component in the polyester (B) can be carried out by reacting the components in an inert gas atmosphere at a temperature of from 120° to 230° C., using an esterification catalyst as occasion demands, a polymerization inhibitor, and the like, or the like. Specifically, a method including the step of charging an entire monomer in a single batch in order to increase the strength of the resin, or alternatively a method including the step of firstly reacting divalent monomers, and thereafter adding and reacting trivalent or higher polyvalent monomers in order to reduce low-molecular weight components, or the like may be employed. In addition, the reaction may be accelerated by reducing a pressure of the reaction system in the latter half of the polymerization. Here, in order to obtain a polyester having high crystallinity in the present invention, it is preferable that the polyester is formed to have a larger molecular weight, and it is more preferable that the reaction is carried out until the viscosity of the reaction mixture becomes high. In order to obtain a polyester having high crystallinity formed to have a larger molecular weight, reaction conditions such as adjustment of the molar ratio of the aliphatic dicarboxylic acid compound to the α,ω-linear alkanediol as mentioned above, elevation of the reaction temperature, increase in the amount of the catalyst, and subjection to a dehydration reaction for a long period of time under reduced pressure may be selected. Incidentally, a polyester having high crystallinity formed to have a larger molecular weight can be also produced by using a high output motor. However, when the polyester is produced without particularly selecting production equipment, a method including the step of reacting raw material monomers together with a non-reactive low-viscosity resin and a solvent is also an effective means.

The number-average molecular weight of the polyester (B) has an adverse effect each on storage property of the toner when it is too low, and on productivity of the toner when it is too high. Therefore, the polyester has a number-average molecular weight of preferably from 5,000 to 10,000, and more preferably from 6,000 to 9,000. The average molecular weight of the resin as used herein is determined according to the methods described in Examples set forth below.

In addition, it is preferable that the polyester (B) contains high-molecular weight component in a certain amount, from the viewpoint of durability of the toner; therefore, the polyester (B) has a weight-average molecular weight of preferably from 40,000 to 100,000, and more preferably from 45,000 to 70,000.

The polyester (B) has a highest temperature of endothermic peak of from 100° to 140° C., preferably from 100° to 130° C., and more preferably from 100° to 120° C., from the viewpoint of fixing ability, storage property and durability of the toner. The highest temperature of endothermic peak as used herein is determined according to the method described in Examples set forth below.

The polyester (B) has a melting point of preferably from 100° to 140° C., more preferably from 100° to 130° C., and even more preferably from 100° to 120° C., from the viewpoint of low-temperature fixing ability of the toner. The melting point as used herein is determined according to the method described in Examples set forth below.

The polyester (A) is contained in an amount of preferably from 60 to 97% by weight, more preferably from 65 to 95% by weight, and even more preferably from 75 to 90% by weight, of the resin binder, from the viewpoint of dispersibility of the negatively chargeable charge control agent the polycondensed product obtained by polycondensation reaction of the phenol and the aldehyde in the resin binder.

The polyester (B) is contained in an amount of preferably from 3 to 40% by weight, more preferably from 5 to 35% by weight, and even more preferably from 10 to 25% by weight, of the resin binder, from the viewpoint of dispersibility of the negatively chargeable charge control agent the polycondensed product obtained by polycondensation reaction of the phenol and the aldehyde in the resin binder. When the polyester (B) is contained in an amount less than 3% by weight, the storage modulus of the toner and the triboelectric charge of the toner are likely to be lowered, and when the polyester (B) is contained in an amount exceeding 40% by weight, the triboelectric charge of the toner is likely to be lowered.

The polyester (A) and the polyester (B) are contained in the toner in a weight ratio, i.e. A/B, of preferably from 60/40 to 97/3, more preferably from 65/35 to 95/5, and even more preferably from 75/25 to 90/10.

Here, in the present invention, the polyester (A) may be a modified polyester to an extent that the properties thereof are not substantially impaired. The modified polyester includes, for example, a polyester grafted or blocked with a phenol, a urethane, an epoxy or the like according to the method described in JP-A-Hei-11-133668, JP-A-Hei-10-239903, JP-A-Hei-8-20636, or the like, or a composite resin containing two or more kinds of resin units including a polyester unit.

Besides the polyester (A) and the polyester (B), the toner in the present invention may properly contain other resin binders within the range so as not to impair the effects of the present invention. The other resin binder includes resin binders besides polyesters, including vinyl resins, epoxy resins, polycarbonates, polyurethanes, and the like. The polyester (A) and the polyester (B) are contained in a total amount, but not particularly limited to, of preferably 95% by weight or more, and more preferably 99% by weight or more, of the resin binder, from the viewpoint of low-temperature fixing ability.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. These colorants can be used alone or in admixture of two or more kinds. The toner produced by the present invention may be any of black toner, color toner, and full-color toner. The colorant is contained in a total amount of preferably from 1 to 40 parts by weight, and more preferably from 3 to 10 parts by weight, based on 100 parts by weight of the resin binder.

In the present invention, besides the pulverized product of the negatively chargeable charge control resin obtained in the step (A), or the negatively chargeable charge control resin that does not soften at a temperature of 180° C. or lower and has an average particle size of from 0.05 to 2 μm, an additive such as a releasing agent, a fluidity improver, an electric conductivity modifier, an extender pigment, a reinforcing filler such as a fibrous material, an antioxidant, an anti-aging agent, or a cleanability improver may be further properly used as the raw materials of the toner other than the resin binder and the colorant.

The releasing agent includes waxes such as synthetic waxes such as polypropylene wax, polyethylene wax, and Fischer-Tropsch wax; coal waxes such as montan wax; petroleum waxes such as paraffin waxes; and alcohol waxes. These waxes may be used alone or in admixture of two or more kinds. The releasing agent is contained in the toner an amount of preferably from 1 to 10 parts by weight, more preferably from 2 to 10 parts by weight, and even more preferably from 3 to 7 parts by weight, based on 100 parts by weight of the resin binder.

In the melt-kneading, it is preferable that the raw materials of the toner such as the resin binder and the colorant, and further additives as occasion demands, besides the pulverized product of the negatively chargeable charge control resin obtained in the step (A), or the negatively chargeable charge control resin that does not soften at a temperature of 180° C. or lower and has an average particle size of from 0.05 to 2 μm are homogenously mixed and thereafter treated with to a kneader. The mixing of the raw materials of the toner may be either a method of mixing all the raw materials such as the resin binder at one time or a method of dividing the raw materials and mixing. As the kneader, an open-roller type kneader, a twin-screw kneader, or the like can be used, and the open-roller type kneader is preferred, from the viewpoint of dispersibility of the negatively chargeable charge control resin.

A mixer used for mixing the raw materials of the toner includes a Henschel mixer, a Super mixer, and the like. A Henschel mixer is preferred from the viewpoint of dispersibility.

In the melt-kneading of the raw materials of the toner, the colorant and the negatively chargeable charge control resin can be efficiently highly dispersed without repeating the kneading or without a dispersion aid, by using a continuous open-roller type kneader provided with feeding inlets and a discharging outlet for a kneaded product arranged along an axial direction of the roller.

The mixture of the raw materials of the toner may be fed to the kneader from one feeding port and may be divided and fed to the kneader from plural feeding ports. It is preferable that the raw materials of the toner are fed to the kneader from one feeding port, from the viewpoint of easiness of operation and simplification of an apparatus.

The continuous open-roller type kneader refers to a kneader of which melt-kneading member is an open type, and can easily dissipate the kneading heat generated during the melt-kneading. In addition, it is desired that the continuous open-roller type kneader is a kneader provided with at least two rollers. The continuous open-roller type kneader preferably used in the present invention is a kneader provided with two rollers having different peripheral speeds, in other words, two rollers of a high-rotation roller having a high peripheral speed and a low-rotation roller having a low peripheral speed. In the present invention, it is desired that the high-rotation roller is a heat roller, and the low-rotation roller is a cooling roller, from the viewpoint of dispersibility of the raw materials of the toner.

The temperature of the roller can be adjusted by, for example, a temperature of a heating medium passing through the inner portion of the roller, and each roller may be divided in two or more portions in the inner portion of the roller, each being communicated with heating media of different temperatures.

In the present invention, it is preferable that the temperature of the roller is set so that the melt-kneading is carried out within the temperature range between a temperature calculated from a softening point of the resin binder plus 10° C. and a temperature calculated from a softening point of the resin binder minus 10° C., and more preferably a temperature range between a temperature calculated from a softening point of the resin binder plus 7° C. and a temperature calculated from a softening point of the resin binder minus 7° C., from the viewpoint of dispersibility of the negatively chargeable charge control resin. In a case where the softening point of the resin binder is lower than the softening point of the negatively chargeable charge control resin, it is also preferable from the viewpoint that the kneading is carried out near the softening point of the resin binder, whereby the negatively chargeable charge control resin can be dispersed in the resin binder without undergoing unification upon melting. Here, in a case where the melt-kneading is carried out with a continuous open-roller type kneader, the temperature of the melt-kneading means a surface temperature of the kneaded product. The surface temperature of the kneaded product can be measured with a non-contact type laser thermometer or the like.

The temperature at the end part of the raw material supplying side of the high-rotation roller is preferably from 100° to 160° C., and the temperature at the end part of the raw material supplying side of the low-rotation roller is preferably from 35° to 100° C.

In the high-rotation roller, the difference between a setting temperature at the end part of the raw material supplying side and a setting temperature at the end part of the kneaded product discharging side is preferably from 20° to 60° C. , more preferably from 30° to 50° C., and even more preferably from 35° to 45° C., from the viewpoint of preventing detachment of the kneaded product from the roller. In the low-rotation roller, the difference between a setting temperature at the end part of the raw material supplying side and a setting temperature at the end part of the kneaded product discharging side is preferably from 0° to 50° C., more preferably from 0° to 40° C., and even more preferably from 0° to 30° C., from the viewpoint of kneading ability of the resin binder and the negatively chargeable charge control resin.

The peripheral speed of the high-rotation roller is preferably from 2 to 100 m/min. The peripheral speed of the low-rotation is preferably from 1 to 90 m/min, more preferably from 2 to 60 m/min, and even more preferably from 2 to 50 m/min. In addition, the ratio between the peripheral speeds of the two rollers, i.e., low-rotation roller /high-rotation roller, is preferably from 1/10 to 9/10, and more preferably from 3/10 to 8/10.

The two rollers may be arranged in parallel to each other, and it is preferable that the two rollers are set so that the gap between the rollers on the end part of the discharge side of the kneaded product is wider than the gap between the roller at the end part of the supplying side, from the viewpoint of even more easing the kneading share, thereby preventing molecular cleavage or the like of the resin. Specifically, the gap between the rollers at the end part of the supplying side of the kneading product is preferably from 0.05 to 2 mm, more preferably from 0.05 to 1 mm, and even more preferably from 0.05 to 0.8 mm, and the gap between the rollers at the end part of the discharge side is preferably from 0.1 to 2 mm, more preferably from 0.3 to 1.5 mm, and even more preferably from 0.5 to 1 mm.

Structures, size, materials and the like of the roller are not particularly limited. Also, the surface of the roller may be any of smooth, wavy, rugged, or other surfaces. In order to increase kneading share, it is preferable that plural spiral ditches are engraved on the surface of each roller.

Subsequently, the melt-kneaded product obtained in the step (B) is subjected to a step (C), and the melt-kneaded product obtained in the step (B') is subjected to a step (C'), respectively.

The step (C) is a step of pulverizing a melt-kneaded product obtained in the step (B) and classifying the pulverized product, and the step (C') is a step of pulverizing a melt-kneaded product obtained in the step (B') and classifying the pulverized product.

It is preferable that the melt-kneaded product obtained in the step (B) and/or the step (B') is pulverized after properly cooling the melt-kneaded mixture to a pulverizable hardness before the pulverization.

The pulverization of the melt-kneaded product may be carried out at one time or in divided plural times. The pulverization preferably includes rough pulverization and fine pulverization from the viewpoint of pulverization efficiency and production efficiency. It is preferable that the melt-kneaded product is subjected to rough pulverization to a size such that the maximum diameter is preferably 3 mm or less, and more preferably 2 mm or less, and thereafter the resulting roughly pulverized product is further subjected to fine pulverization by taking into consideration a desired toner particle size. The phrase "the maximum diameter of 3 mm or less" as used herein means that all of the toner particles pass through a sieve having an opening of 3 mm. Similarly, the phrase "the maximum diameter of 2 mm or less" as used herein means that all of the toner particles pass through a sieve having an opening of 2 mm.

As the pulverizer used in the subjection of the melt-kneaded product to rough pulverization, Atomizer, Rotoplex, or the like can be used.

The pulverizer used in the fine pulverization of the roughly pulverized product includes a jet type pulverizer such as a fluidized bed type jet mill and a gas stream type jet mill; a mechanical pulverizer such as a turbo mill; and the like. In the present invention, the jet type pulverizer is preferred from the viewpoint of pulverizability.

The fluidized bed type jet mill used in the present invention includes a pulverizer having the structure and principle for finely pulverizing the particles, containing at least a pulverization chamber arranged facing two or more jet nozzles in its lower portion thereof, in which a fluidized bed is formed with the particles fed into the pulverizing container by a high-speed gas jet stream discharged from the jet nozzles wherein the particles are finely pulverized by repeating the acceleration of the particles and impact between the particles in the fluidized bed.

In the jet mill having the above-mentioned structure, the number of jet nozzles is not particularly limited. It is preferable that two or more jet nozzles, and preferably from 3 to 4 jet nozzles are arranged facing each other, from the viewpoint of balance among volume of air, amount of flow and flow rate, impact efficiency of the particles, and the like.

Further, a classifying rotor for capturing uplifted particles having small particle sizes downsized by pulverization is provided in an upper part of the pulverization chamber. The particle size distribution can be easily adjusted by a rotational speed of the classifying rotor. The finely pulverized product (classified powder obtained by cutting off its upper limit) can be obtained by classifying the pulverized product with the classifying rotor.

The classifying rotor may be arranged in any of longitudinal direction and latitudinal direction against the vertical direction. It is preferable that the classifying rotor is arranged in the longitudinal direction, from the viewpoint of classifying performance.

Specific examples of a fluidized bed type jet mill provided with plural jet nozzles and further containing a classifying rotor include pulverizers disclosed in JP-A-Showa-60-166547 and JP-A-2002-35631.

The fluidized-bed jet mill which may be preferably used in the present invention includes the "TFG" Series commercially available from Hosokawa Micron Corporation, the "AFG" Series commercially available from Hosokawa Micron Corporation, and the like.

In addition, the gas stream type jet mill includes, for example, an impact type jet mill containing a venturi nozzle and an impact member arranged so as to face the venturi nozzle, and the like.

The gas stream type jet mill which may be preferably used in the present invention includes the "IDS" Series commercially available from Nippon Pneumatic Mfg. Co., Ltd., and the like.

Subsequently, the finely pulverized product obtained above is classified.

The classifier includes air classifiers, rotor type classifiers, sieve classifiers, and the like. In the present invention, it is preferable that the classifier contains a classifying rotor containing a driving shaft arranged in a casing as a central shaft thereof in a vertical direction, and a stationary spiral guiding vane arranged to share the same central shaft as the classifying rotor, wherein the stationary spiral guiding vane is arranged in a classification zone on an outer circumference of the classifying rotor with a given spacing to the outer circumference of the classifying rotor, from the viewpoint of ability of removing fine powders. Specific examples of the classifier having the structure described above include a classifier shown in FIG. 2 of JP-A-Hei-11-216425, a classifier shown in FIG. 6 of JP2004-78063A, commercially available classifiers such as the "TSP" Series and the "TTSP" Series commercially available from Hosokawa Micron Corporation, and the like.

It is preferable that the classifier used in the present invention is used in the classification of fine powder to remove mainly fine powders, i.e. to cut off its lower limit. The fine powders removed may be again subjected to the classifier because the necessary portion of the fine powders is recaptured by re-classification.

A toner is thus obtained through the above steps, and the surface of the toner obtained may be subjected to a surface treatment by externally adding fine inorganic particles of a hydrophobic silica or fine resin particles. It is preferable that the surface treatment is a method including the step of externally adding an external additive such as a fluidity improver such as a hydrophobic silica to a surface of the toner with a mixer such as a Henschel mixer. As the external additive, known fine particles, including fine inorganic particles, such as fine hydrophobic silica particles, fine hydrophobic titanium oxide particles, fine alumina particles, fine cerium oxide particles, and carbon black; and fine polymer particles of polycarbonate, polymethyl methacrylate, silicone resin, or the like can be used.

The toner obtained by the present invention has a volume-median particle size ($D_{50}$) of preferably from 3.0 to 9.0 μm, more preferably from 4.0 to 9.0 μm, even more preferably from 4.0 to 7.0 μm, and even more preferably from 5.0 to 7.0 μm. The term "volume-median particle size ($D_{50}$)" as used herein refers to a particle size of which cumulative volume frequency calculated on a volume percentage is 50% counted from the smaller particle sizes, and measured according to the method described in Examples set forth below.

In addition, since the toner obtained by the present invention has excellent dispersibility of the negatively chargeable charge control resin, the negatively chargeable charge control resin in the toner has an average particle size of preferably from 0.05 to 1.0 μm, more preferably from 0.05 to 0.5 μm, and even more preferably from 0.1 to 0.5 μm. The average particle size of the negatively chargeable charge control resin as used herein is measured according to the method described in Examples set forth below.

The toner obtained by the present invention can be used without being limited in its development method, and any of toners for monocomponent development and toners for two-component development can be used. Since the toner obtained by the present invention has excellent triboelectric chargeability, and the toner is preferably used in the monocomponent development for which a stress is strong.

EXAMPLES

The following examples further describe and demonstrate embodiments of the present invention. The examples are given solely for the purposes of illustration and are not to be construed as limitations of the present invention.

[Softening Point of Resin]

The softening point refers to a temperature at which a half the amount of the sample flows out when plotting a downward movement of a plunger of a flow tester against temperature, as measured by using a flow tester (CAPILLARY RHEOMETER "CFT-500D," commercially available from Shimadzu Corporation), in which a 1 g sample is extruded through a nozzle having a diameter of 1 mm and a length of 1 mm while heating the sample so as to raise the temperature at a rate of 6° C./min and applying a load of 1.96 MPa thereto with the plunger.

[Acid Value of Resin]

The acid value is determined by a method according to JIS K0070 except that only the determination solvent is changed from a mixed solvent of ethanol and ether as defined in JIS K0070 to a mixed solvent of acetone and toluene (volume ratio of acetone:toluene=1:1).

[Highest Temperature of Endothermic Peak and Glass Transition Temperature of Resin]

The highest temperature of endothermic peak is determined using a differential scanning calorimeter ("Q-100," commercially available from TA Instruments, Japan), by cooling a sample from room temperature to 0° C. at a cooling rate of 10° C./min, allowing the cooled sample to stand for 1 minute, and thereafter heating the sample at a rate of 50° C./min. When a difference between the highest temperature of endothermic peak and the softening point is within 20° C., a temperature of an intersection of the extension of the baseline of equal to or lower than the highest temperature of endothermic peak and the tangential line showing the maximum inclination between the kick-off of the peak and the top of the peak is read as a glass transition temperature. When a difference between the highest temperature of endothermic peak and the softening point exceeds 20° C., a temperature of an intersection of the extension of the baseline of equal to or lower than the temperature of a peak observed at a temperature lower than the highest temperature of endothermic peak and the tangential line showing the maximum inclination between the kick-off of the peak and the top of the peak is read as a glass transition temperature.

[Volume-Median Particle Size ($D_{50}$) of Toner]

The term "volume-median particle size ($D_{50}$)" of the toner as used herein means a particle size of the toner, of which cumulative volume frequency calculated on a volume percentage is 50% counted from the smaller particle sizes. Measuring Apparatus: Coulter Multisizer II (commercially available from Beckman Coulter K.K.)

Aperture Diameter: 50 μm

Analyzing Software: Coulter Multisizer AccuComp Ver. 1.19 (commercially available from Beckman Coulter K.K.)

Electrolytic Solution: "Isotone II" (commercially available from Beckman Coulter K.K.)

Dispersion: "EMULGEN 109P" (commercially available from Kao Corporation, polyoxyethylene lauryl ether, HLB: 13.6) is dissolved in the above electrolytic solution so as to have a concentration of 5% by weight, to give a dispersion.

Dispersion Conditions: Ten milligrams of a test sample is added to 5 mL of the above dispersion, and the resulting mixture is dispersed in an ultrasonic disperser for 1 minute. Thereafter, 25 mL of the electrolytic solution is added thereto, and the resulting mixture is dispersed in the ultrasonic disperser for another 1 minute, to give a sample dispersion.

Measurement Conditions: The above sample dispersion is adjusted so as to have a concentration at which the particle sizes of 30,000 particles can be determined in 20 seconds by adding 100 mL of the above electrolytic solution to the above sample dispersion. Thereafter, the particle sizes of 30,000 particles are determined to obtain a volume-median particle size ($D_{50}$) from the particle size distribution.

[Triboelectric Charges of the Toner]

A specified amount of a developer is supplied in a cell provided in the Q/M meter, and only toner is aspirated for 90 seconds through a sieve having a sieve opening of 32 μm (made of stainless steel, wire diameter: 0.035 mm). The voltage change generated on the carrier at this time is monitored, and the value of [Total Electric Charges (μC) After 90 Seconds/Weight (g) of Toner Aspirated] is calculated as the triboelectric charges (μC/g).

[Judgment that Negatively Chargeable Charge Control Resin Softens at Temperature of 180° C. or Lower]

The endothermic peaks attributable to the softening point upon the determination by heating at a rate of 10° C./minute from 20° to 200° C. with a differential scanning calorimeter are observed. If the peaks are not observed at a temperature of 180° C. or lower, it is judged that the negatively chargeable charge control resin does not soften at a temperature of 180° C. or lower.

[Average Particle Size of Negatively Chargeable Charge Control Resin]

The phrase "average particle size of the negatively chargeable charge control resin" as used herein means a particle size the negatively chargeable charge control resin of which cumulative volume frequency calculated on a volume percentage is 50% counted from the smaller particle sizes. Measuring Apparatus: Laser diffraction particle size analyzer "LA-920" (commercially available from HORIBA, Ltd.)

Dispersion: "EMULGEN 109P" (commercially available from Kao Corporation, polyoxyethylene lauryl ether, HLB: 13.6) is dissolved in ion-exchanged water so as to have a concentration of 5% by weight, to give a dispersion.

Dispersion Conditions: Ten milligrams of a test sample is added to 5 mL of the above dispersion, and the resulting mixture is dispersed in an ultrasonic disperser for 1 minute, to give a sample dispersion.

Measurement Conditions: To the measurement cell is added ion-exchanged water and then the above-mentioned sample dispersion is added thereto. The particles are subjected to a measurement at a concentration at which the absorbance is appropriate, and an average particle size is obtained from the particle size distribution.

[Average Particle size of Negatively Chargeable Charge Control Resin in the Toner]

The average particle size of the negatively chargeable charge control resin in the toner refers to a number-average particle size, which is obtained by the following method.

The cross section of the toner is observed with TEM (transmission electron microscope) (commercially available from JEOL Ltd., JEM2100) at a magnification of 5,000 folds. An average of the length and the breadth of the negatively chargeable charge control resin is defined as a particle size, and an average of particle sizes of 100 particles is defined as a number-average particle size. Here, among the parallel lines drawn so as to contact the contour of each of the negatively chargeable charge control resin on the cross section of the toner, the parallel lines that form the maximum distance between the parallel lines are defined as length, and the parallel lines that form the minimum distance between the parallel lines that are defined as breadth.

Resin Production Example 1

A 5-liter four-necked flask equipped with a nitrogen inlet tube, a dehydration tube, a stirrer and a thermocouple was charged with 3308 g (90 mol) of polyoxypropylene(2.2)-2,2-bis(4-hydroxyphenyl)propane (BPA-PO), 341 g (10 mol) of polyoxyethylene(2.2)-2,2-bis(4-hydroxyphenyl)propane (BPA-EO), 792 g of fumaric acid (65 mol, based on a total amount of 100 mol of BPA-PO and BPA-EO), 5 g of hydroquinone, and 10 g of dibutyltin oxide (0.23 parts by weight, based on 100 parts by weight of the total amount of the alcohol component and the carboxylic acid component), and the mixture obtained was heated to from 180° to 210° C. over 5 hours under nitrogen atmosphere, and reacted, and further reacted at 8.3 kPa for 1 hour. Thereafter, 480 g of trimellitic anhydride (23.8 mol, based on a total amount of 100 mol of BPA-PO and BPA-EO) was supplied to the mixture, the mixture was reacted at normal pressure (101.3 kPa) for 1 hour, and the mixture was then reacted at 8.3 kPa until a desired softening point was attained, to give a resin composition. The resulting resin had a softening point of 155.8° C., a glass transition temperature of 64.7° C., an acid value of 33.2 mgKOH/g, a highest temperature of endothermic peak of 72.5° C., and a ratio of the softening point/the highest peak temperature of 2.15. The resulting resin is referred to as a resin A.

Resin Production Example 2

A 5-liter four-necked flask equipped with a nitrogen inlet tube, a dehydration tube, a stirrer and a thermocouple was charged with 1286 g (35 mol) of polyoxypropylene(2.2)-2,2-bis(4-hydroxyphenyl)propane (BPA-PO), 2218 g (65 mol) of polyoxyethylene(2.2)-2,2-bis(4-hydroxyphenyl)propane (BPA-EO), 1603 g of terephthalic acid (92 mol, based on a total amount of 100 mol of BPA-PO and BPA-EO), and 10 g of dibutyltin oxide (0.20 parts by weight, based on 100 parts by weight of the total amount of the alcohol component and the carboxylic acid component). The mixture was reacted at 230° C. under nitrogen atmosphere until a reaction rate of 90% was attained, and the mixture obtained was then reacted at 8.3 kPa until a desired softening point was attained, to give a resin composition. The resulting resin had a softening point of 111.4° C., a glass transition temperature of 68.5° C., an acid value of 3.2 mgKOH/g, a highest temperature of endothermic peak of 73.5° C., and a ratio of the softening point/the highest peak temperature of 1.52. The resulting resin is referred to as a resin B. The reaction rate as used herein means a value defined by a value calculated by [the empirical amount of formed water (mol)]/[the theoretical amount of formed water (mol)]×100.

Resin Production Example 3

A 5-liter four-necked flask equipped with a nitrogen inlet tube, a dehydration tube, a stirrer and a thermocouple was charged with 2997 g (72 mol) of 1,4-butanediol, 1637 g (30 mol) of 1,6-hexanediol, 5365 g(100 mol) of fumaric acid, and 5.5 g of t-butyl catechol (TBC) (0.06 parts by weight, based on 100 parts by weight of the total amount of the alcohol component and the carboxylic acid component), and the mixture was reacted at 160° C. over 5 hours, and then heated to 200° C. and reacted for 1 hour. Further, the mixture was reacted at 8.3 kPa until a desired molecular weight was attained, to give a resin composition. The resulting resin had a softening point of 115.0° C., a highest temperature of endothermic peak of 110° C., and a ratio of the softening point/the highest peak temperature of 1.05. The resulting resin is referred to as a resin a.

Production Example 1 of Negatively Chargeable Charge Control Agent

A reflux reaction was carried out in 300 mL of xylene, using 0.225 mol of p-t-butylphenol, 0.225 mol of p-t-octylphenol, 0.032 mol of 2,2-bis(4-hydroxyphenyl)propane, 18.5 g of paraformaldehyde (0.6 mol in terms of formaldehyde), and 3 g of a 5N aqueous potassium hydroxide solution while distilling off water at 120° C. for 8 hours. The reaction mixture was recrystallized from methanol, and filtered, the residue was further washed with methanol, and the solid obtained was dried, to give a charge control agent a. The resulting charge control agent a did not soften at a temperature of 180° C. or lower. Here, the p-alkylphenol (a) and the bisphenol compound (b) are contained in the phenol in amounts of 93% by mol and 7% by mol (a molar ratio a/b of 93/7), respectively, and the molar ratio of the phenol to the aldehyde is 1/1.2.

Examples 1 to 4 and Comparative Examples 1 to 4

Thirty parts by weight of the resin A, 70 parts by weight of the resin B, 5.0 parts by weight of a releasing agent "HNP-9" (commercially available from Nippon Seiro), 3.0 parts by weight of "Pigment Yellow 185" (commercially available from BASF) and 2.0 parts by weight of "Pigment Yellow 74" (commercially available from DAINICHISEIKA COLOR & CHEMICALS MFG. CO., LTD.) as colorants, and 3.0 parts by weight of the negatively chargeable charge control resin as shown in Table 1 were previously mixed with a Henschel mixer. Thereafter, the mixture was melt-kneaded with a continuous twin roller type kneader "Kneadex" (commercially available from MITSUI MINING COMPANY, LIMITED) having an outer diameter of the roller of 0.14 m and an effective roller length of 0.7 m under the conditions as shown in Table 1, to give a kneaded mixture. The pulverization conditions and the melt-kneading conditions of the negatively chargeable charge control resin are as given below.

[Wet Pulverization of Negative Chargeable Charge Control Resin]

The wet pulverization was carried out with a wet pulverizer "Ball-Mill SC100/32-ZZ" (commercially available from MITSUI MINING COMPANY, LIMITED). Five-hundred grams of the negatively chargeable charge control resin was dispersed in 2833 g of ethanol (15% by weight), and mixed with 760 g of zirconia balls (diameter: 0.2 μm) at a circulating flow rate of 3 L/min, 25° C. for 120 minutes. The resulting pulverized product was dried in a bucket, and the re-aggregated mass formed by drying was disintegrated with a 10 L Henschel mixer (ST/A0 blades, 300 rotations/min, 1 minute).

[Dry Pulverization of Negative Chargeable Charge Control Resin]

The dry pulverization was carried out with "Jet Mill IDS-2" (commercially available from Nippon Pneumatic Mfg. Co., Ltd.)." The operating conditions were such that a pulverization pressure of 0.5 MPa, the impact plates were conical, and the pulverization feed was 2 kg/h.

[Melt-Kneading Conditions A]

The operating conditions were such that the gap between the roller, i.e. clearance, at the end part of the supplying side of the kneaded product was 0.2 mm, that a peripheral speed of a high-rotation roller (front roller) was 33 m/min and a peripheral speed of a low-rotation roller (back roller) was 22 m/min, that the high-rotation roller had a temperature of at the supplying side of raw materials of 130° C. and a temperature at the discharging side of the kneaded mixture of 100° C., and that the low-rotation roller had a temperature at the supplying side of raw materials of 75° C., and a temperature at the discharging side of the kneaded mixture of 35° C. In addition, the raw material mixture had a feeding rate of 10 kg/hour, and an average residence time was about 10 minutes.

[Melt-Kneading Conditions B]

The operating conditions were such that the gap between the roller, i.e. clearance, at the end part of the supplying side of the kneaded product was 0.2 mm, that a peripheral speed of a high-rotation roller (front roller) was 33 m/min and a peripheral speed of a low-rotation roller (back roller) was 11 m/min, that the high-rotation roller had a temperature of at the supplying side of raw materials of 130° C. and a temperature at the discharging side of the kneaded mixture of 100° C., and that the low-rotation roller had a temperature at the supplying side of raw materials of 75° C., and a temperature at the discharging side of the kneaded mixture of 35° C. In addition, the raw material mixture had a feeding rate of 10 kg/hour, and an average residence time was about 10 minutes.

[Melt-Kneading Conditions C]

The operating conditions were such that the gap between the roller, i.e. clearance, at the end part of the supplying side of the kneaded product was 0.1 mm, that a peripheral speed of a high-rotation roller (front roller) was 33 m/min and a peripheral speed of a low-rotation roller (back roller) was 11 m/min, that the high-rotation roller had a temperature of at the supplying side of raw materials of 130° C. and a temperature at the discharging side of the kneaded mixture of 100° C., and that the low-rotation roller had a temperature at the supplying side of raw materials of 75° C., and a temperature at the discharging side of the kneaded mixture of 35° C. In addition, the raw material mixture had a feeding rate of 10 kg/hour, and an average residence time was about 10 minutes.

Next, the resulting melt-kneaded mixture was rolled with a cooling roller to cool, the cooled mixture was then roughly pulverized with an atomizer, and the resulting pulverized product was finely pulverized with "AFG" (commercially available from Hosokawa Micron Corporation). The resulting pulverized product was subjected to classification with "TTSP" (commercially available from Hosokawa Micron Corporation) by cutting off its lower limit, to give each of the toners of Examples 1 to 4 and Comparative Examples 1 to 4, each having a volume-medium particle size ($D_{50}$) of 5.5 μm.

Test Example 1

[Background Fog]

Each toner of Examples and Comparative Examples was loaded in a nonmagnetic monocomponent development device "Oki Microline 5400" (commercially available from Oki Data Corporation) equipped with an organic photoconductor (OPC), and allowed to stand under the environmental conditions of 25° C. and 50% RH for 12 hours, blank sheets having a printing ratio of 0% were then printed out. Thereafter, the toner remaining on the photoconductive drum was transferred to a mending tape, and an image density difference ΔE with the reference was determined with a color-difference meter "X-Rite" (commercially available from X-Rite) to evaluate the background fog. As the reference, a mending tape without any treatment was used. Here, if ΔE is less than 2.0, the results are excellent. The results are shown in Table 1.

Test Example 2

[High-Temperature Offset Resistance]

The toner of each of Examples and each of Comparative Examples was loaded in a nonmagnetic monocomponent development device "Oki Microline 5400" (commercially available from Oki Data Corporation), and a solid patch of 3 cm×8 cm was printed on Xerox L sheet (A4) with a 3 cm margin from the top of the length direction with adjusting the amount of toner adhered to 0.45 mg/cm$^2$, and the printout was taken out in an unfixed state, to give L sheet printed with an unfixed image.

Next, the L sheet printed with an unfixed image was fixed with an external fixing device, a modified fixing device of "Microline 3050" (commercially available from Oki Data Corporation) at a fixing speed of 100 mm/sec, while raising the fixing temperature from 160° to 190° C. in an increment of 5° C. Here, it was visually confirmed if any soils due to high-temperature offset were generated in the circulating part of the fixing roller, i.e. the lower part of the L sheet. The lowest temperature at which the soils caused by the high-temperature offset is confirmed is referred to as a temperature of high-temperature offset generation. The higher the temperature of high-temperature offset generation, the more favorable. The results are shown in Table 1.

TABLE 1

| | Negatively Chargeable Charge Control Resin | | | | Physical Properties of Toner | | Properties of Toner | |
|---|---|---|---|---|---|---|---|---|
| | Kind | Pulverization Conditions | Average Particle Size Before Melt-Kneading (μm) | Melt-Kneading Conditions | Average Particle Size of Charge Control Resin (μm) | Triboelectric Charges (μC/g) | Background Fog | Temperature of High-Temperature Offset Generation (° C.) |
| Ex. 1 | Charge Control Agent a | Dry Pulverization | 2.0 | Conditions A | 0.7 | −58 | 0.7 | 185 |
| Ex. 2 | Charge Control Agent a | Wet Pulverization | 0.5 | Conditions A | 0.4 | −63 | 0.5 | 190< |
| Ex. 3 | Charge Control Agent a | Wet Pulverization | 0.5 | Conditions B | 0.1 | −65 | 0.4 | 190< |
| Comp. Ex. 1 | Charge Control Agent a | — | 30 | Conditions A | 2.0 | −40 | 1.8 | 160 |

TABLE 1-continued

| | Negatively Chargeable Charge Control Resin | | | | Physical Properties of Toner | | Properties of Toner | |
|---|---|---|---|---|---|---|---|---|
| | Kind | Pulverization Conditions | Average Particle Size Before Melt-Kneading (μm) | Melt-Kneading Conditions | Average Particle Size of Charge Control Resin (μm) | Triboelectric Charges (μC/g) | Background Fog | Temperature of High-Temperature Offset Generation (° C.) |
| Comp. Ex. 2 | Charge Control Agent a | — | 30 | Conditions B | 0.9 | −53 | 1.1 | 180 |
| Comp. Ex. 3 | Charge Control Agent a | — | 30 | Conditions C | 0.4 | −60 | 0.6 | 170 |
| Ex. 4 | Charge Control Agent b | Dry Pulverization | 0.2 | Conditions A | 0.1 | −40 | 1.9 | 180 |
| Comp. Ex. 4 | Charge Control Agent b | — | 0.4 | Conditions A | 0.4 | −35 | 2.2 | 170 |

Note:

Charge Control Agent b: a calixarene compound "F-21" (a mixture of compounds represented by the formula (Ia), wherein x is 6 to 8), commercially available from Orient Chemical Co., Ltd., that does not soften at a temperature of 180° C. or lower.

It can be seen that the toners of Examples 1 to 3 have high triboelectric charges, reduced generation of background fog, and excellent high-temperature offset resistance, as compared to those of Comparative Example 1 to 3. In addition, despite the fact that the kind of the charge control resin used and the average particle size of the charge control resin in the toner are the same in the toners of Example 2 and Comparative Example 3, since the toner of Example 2 obtained by pulverization of the charge control resin has reduced generation of background fog, and excellent high-temperature offset resistance, it is suggested that a pulverized product of the charge control resin having a more even particle size is obtained by previously pulverizing only the charge control resin, and the pulverized product is melt-kneaded with a polyester, whereby suggesting that excellent dispersibility of the charge control resin is obtained and further the affinity between the charge control agent and the polyester is improved. It can be seen from the comparison of the toner of Comparative Example 4 and the toner of Example 4 that even when a calixarene compound is used, the toner of Example 4 in which the charge control resin is previously pulverized has reduced generation of background fog and a high temperature of high-temperature offset generation, so that the toner satisfies both the triboelectric chargeability and the high-temperature offset resistance.

Examples 5 and 6

The same procedures as in Example 1 were carried out except that the resins shown in Table 2 were used in amounts shown in Table 2 in place of 30 parts by weight of Resin A and 70 parts by weight of Resin B, to give toners of Examples 5 and 6. Here, the melt-kneading was carried out under conditions shown in Table 2.

The following properties were evaluated for the toners obtained in Examples 5 and 6 and the toner of Example 1 in accordance with Test Examples 3 and 4 given hereinbelow. The results are shown in Table 2.

Test Example 3

[Temperature of Low-Temperature Offset Generation]

The toner of each of Examples was loaded in a nonmagnetic monocomponent development device "Oki Microline 5400" (commercially available from Oki Data Corporation), and an unfixed image (3 cm×8 cm) was obtained on Xerox L sheet (A4), with adjusting the amount of toner adhered to 0.50 mg/cm$^2$. The unfixed image obtained was fixed with an external fixing device, a modified fixing device of "MicroLine 3050" (commercially available from Oki Data Corporation) at a fixing speed of 100 mm/sec, while raising the temperature of the fixing roller from 130° C. in an increment of 5° C. The highest temperature at which the soils on paper surface caused by the offset on low-temperature side are observed is referred to as a temperature of low-temperature offset generation.

Test Example 4

[Solid Image Quality]

The toner of each of Examples was loaded in a nonmagnetic monocomponent development device "Oki Microline 5400" (commercially available from Oki Data Corporation), and allowed to stand under environmental conditions of 25° C./50% RH for 12 hours, and an image having a printing ratio of 100% was printed for 100 sheets. Of the images obtained, a 10th image, a 50th image, and a 100th image were visually observed, and the solid image quality was evaluated in accordance with the following evaluation criteria.

[Evaluation Criteria for Solid Image Quality]

A: no blurs are generated up to a 100th sheet;

B: no blurs are generated up to a 50th sheet; and blurs are observed on the 100th sheet;

C: no blurs are generated up to a 10th sheet; and blurs are observed on the 50th sheet; and D: blurs are observed on the 10th sheet.

TABLE 2

| | Resin Binder | | | Negatively Chargeable Charge Control Resin | | | | Physical Properties of Toner | | Properties of Toner | |
|---|---|---|---|---|---|---|---|---|---|---|---|
| | Polyester (A) | | Polyester | | | Average Particle Size Before | Melt- | Average Particle Size of Charge | Triboelectric | Temperature of Low-Temperature | Solid |
| | Resin A | Resin B | (B) Resin a | Kind | Pulverization Conditions | Melt-Kneading (μm) | Kneading Conditions | Control Resin (μm) | Charges (μC/g) | Offset Generation (° C.) | Image Quality |
| Ex. 1 | 30 | 70 | — | Charge Control Agent a | Dry Pulverization | 2.0 | Conditions A | 0.7 | −58 | 165 | D |
| Ex. 5 | 10 | 70 | 20 | Charge Control Agent a | Dry Pulverization | 2.0 | Conditions A | 0.4 | −64 | 145 | A |
| Ex. 6 | 25 | 70 | 5 | Charge Control Agent a | Dry Pulverization | 2.0 | Conditions A | 0.6 | −62 | 155 | C |

Note)
The amount of the resin binder used is expressed by parts by weight.

It can be seen from the results of Table 2 that the toners of Examples 5 and 6 have high triboelectric charges, low temperatures of low-temperature offset generation and excellent solid image quality, as compared to those of the toner of Example 1. From the above, it is presumed that the triboelectric chargeability is more improved by a synergistic effect of the resin a having high crystallinity which is said to be disadvantage as a resin binder in triboelectric chargeability and the negatively chargeable charge control agent a. In addition, since the toner has excellent triboelectric chargeability, the toners of Examples 5 and 6 presumably have an equivalent level or higher background fog than that of Example 1.

The toner obtained according to the present invention is suitably used in, for example, the development of a latent image formed in electrophotography, electrostatic recording method, electrostatic printing method or the like.

The present invention being thus described, it will be obvious that the same may be varied in ways. Such variations are not to be regarded as a departure from the spirit and scope of the invention, and all such modifications as would be obvious to one skilled in the art are intended to be included within the scope of the following claims.

What is claimed is:

1. A method for producing a toner, comprising at least the following steps (B') and (C'):

step (B'): melt-kneading a negatively chargeable charge control resin that does not soften at a temperature of 180° C. or lower and has an average particle size of from 0.05 to 2 μm, a resin binder, and a colorant; and step (C'): pulverizing a melt-kneaded product obtained in the step (B') and classifying the pulverized product.

2. The method according to claim 1, wherein the negatively chargeable charge control resin comprises a polycondensed product obtained by polycondensation reaction of a phenol and an aldehyde, wherein the phenol comprises a p-alkylphenol (a) having one phenolic hydroxyl group and having no substituents at the ortho-position of the phenolic hydroxyl group, and a bisphenol compound (b) having two phenolic hydroxyl groups and having no substituents at the ortho-position of each phenolic hydroxyl group.

3. The method according to claim 2, wherein the bisphenol compound (b) is contained in an amount of from 1 to 30% by mol of the phenol, and wherein the aldehyde is at least one member selected from the group consisting of paraformaldehyde and formaldehyde.

4. The method according to claim 2, wherein the p-alkylphenol (a) is a compound represented by the following formula (i):

(i)

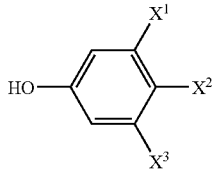

wherein each of $X^1$ and $X^3$ is independently a hydrogen atom, a halogen, or an alkyl group having 1 to 3 carbon atoms; and $X^2$ is an alkyl group having 1 to 12 carbon atoms, and wherein the bisphenol compound (b) is a compound represented by the following formula (ii):

(ii)

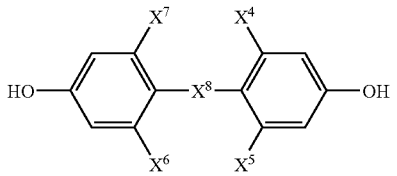

wherein each of $X^4$, $X^5$, $X^6$ and $X^7$ is independently a hydrogen atom, a halogen, or an alkyl group having 1 to 3 carbon atoms; and $X^8$ is an alkylene group having 1 to 5 carbon atoms.

5. The method according to claim 2, wherein a molar ratio of raw materials for the polycondensation reaction of the phenol and the aldehyde, i.e. the phenol/the aldehyde, is from 1/0.5 to 1/5.

6. The method according to claim 1, wherein the resin binder comprises at least:

a polyester (A) obtained by polycondensing an alcohol component comprising an alkylene oxide adduct of bisphenol A in an amount of from 90 to 100% by mol, and a carboxylic acid component comprising an aromatic carboxylic acid compound in an amount of from 75 to 100% by mol; and a polyester (B) obtained by polycondensing an alcohol component comprising an α,ω-linear alkanediol in an amount of from 90 to 100% by mol and a carboxylic acid component comprising an aliphatic dicarboxylic acid component in an amount of from 90 to 100% by mol, wherein the polyester (B) is contained in an amount of from 3 to 40% by weight of the resin binder.

7. The method according to claim 6, wherein in the polyester (B), the α,ω-linear alkanediol is 1,4-butanediol, 1,6-hexanediol, or a mixture thereof, and the aliphatic dicarboxylic acid compound is fumaric acid.

8. The method according to claim 1, wherein the melt-kneading of the step (B') is carried out in a temperature range between a temperature calculated from a softening point of the resin binder plus 10° C. and a temperature calculated from a softening point of the resin binder minus 10° C.

9. A method for producing a toner, comprising at least the following steps (A) to (C):

step (A): pulverizing a negatively chargeable charge control resin that does not soften at a temperature of 180° C. or lower to an average particle size of from 0.05 to 2 μm;

step (B): melt-kneading at least a pulverized product of the negatively chargeable charge control resin obtained in the step (A), a resin binder, and a colorant; and step (C): pulverizing a melt-kneaded product obtained in the step (B) and classifying the pulverized product.

10. The method according to claim 9, wherein the pulverizing of the step (A) is a wet pulverization.

11. The method according to claim 9, wherein the negatively chargeable charge control resin comprises a polycondensed product obtained by polycondensation reaction of a phenol and an aldehyde, wherein the phenol comprises a p-alkylphenol (a) having one phenolic hydroxyl group and having no substituents at the ortho-position of the phenolic hydroxyl group, and a bisphenol compound (b) having two phenolic hydroxyl groups and having no substituents at the ortho-position of each phenolic hydroxyl group.

12. The method according to claim 11, wherein the bisphenol compound (b) is contained in an amount of from 1 to 30% by mol of the phenol, and wherein the aldehyde is at least one member selected from the group consisting of paraformaldehyde and formaldehyde.

13. The method according to claim 11, wherein the p-alkylphenol (a) is a compound represented by the following formula (i):

(i)

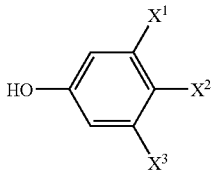

wherein each of $X^1$ and $X^3$ is independently a hydrogen atom, a halogen, or an alkyl group having 1 to 3 carbon atoms; and $X^2$ is an alkyl group having 1 to 12 carbon atoms, and wherein the bisphenol compound (b) is a compound represented by the following formula (ii):

(ii)

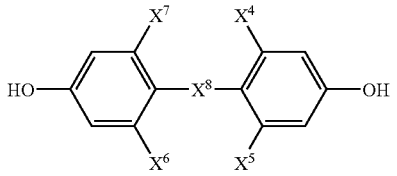

wherein each of $X^4$, $X^5$, $X^6$ and $X^7$ is independently a hydrogen atom, a halogen, or an alkyl group having 1 to 3 carbon atoms; and $X^8$ is an alkylene group having 1 to 5 carbon atoms.

14. The method according to claim 11, wherein a molar ratio of raw materials for the polycondensation reaction of the phenol and the aldehyde, i.e. the phenol/the aldehyde, is from 1/0.5 to 1/5.

15. The method according to claim 9, wherein the resin binder comprises at least:

a polyester (A) obtained by polycondensing an alcohol component comprising an alkylene oxide adduct of bisphenol A in an amount of from 90 to 100% by mol, and a carboxylic acid component comprising an aromatic carboxylic acid compound in an amount of from 75 to 100% by mol; and a polyester (B) obtained by polycondensing an alcohol component comprising an α,ω-linear alkanediol in an amount of from 90 to 100% by mol and a carboxylic acid component comprising an aliphatic dicarboxylic acid component in an amount of from 90 to 100% by mol, wherein the polyester (B) is contained in an amount of from 3 to 40% by weight of the resin binder.

16. The method according to claim 15, wherein in the polyester (B), the α,ω-linear alkanediol is 1,4-butanediol, 1,6-hexanediol, or a mixture thereof, and the aliphatic dicarboxylic acid compound is fumaric acid.

17. The method according to claim 9, wherein the melt-kneading of the step (B) is carried out in a temperature range between a temperature calculated from a softening point of the resin binder plus 10° C. and a temperature calculated from a softening point of the resin binder minus 10° C.

* * * * *